US011336048B2

(12) United States Patent
Refai

(10) Patent No.: US 11,336,048 B2
(45) Date of Patent: May 17, 2022

(54) CASING FOR CONNECTING POWER CORDS

(71) Applicant: New Crescent Pty Ltd, Beecroft (AU)

(72) Inventor: Aiden Refai, Beecroft (AU)

(73) Assignee: New Crescent Pty Ltd, Beecroft (AU)

( * ) Notice: Subject to any disclaimer, the term of this patent is extended or adjusted under 35 U.S.C. 154(b) by 0 days.

(21) Appl. No.: 16/845,071

(22) Filed: Apr. 10, 2020

(65) Prior Publication Data

US 2020/0244002 A1 Jul. 30, 2020

Related U.S. Application Data

(63) Continuation of application No. 16/306,564, filed as application No. PCT/AU2017/050538 on Jun. 2, 2017, now Pat. No. 10,658,786.

(30) Foreign Application Priority Data

Jun. 2, 2016 (AU) ..... 2016203688

(51) Int. Cl.
*H01R 13/52* (2006.01)
*H01R 13/639* (2006.01)
*H01R 13/58* (2006.01)

(52) U.S. Cl.
CPC ..... *H01R 13/5202* (2013.01); *H01R 13/582* (2013.01); *H01R 13/6392* (2013.01)

(58) Field of Classification Search
CPC ..... H01R 13/5202; H01R 13/5208; H01R 13/58; H01R 13/582; H01R 13/639; H01R 13/6392
See application file for complete search history.

(56) References Cited

U.S. PATENT DOCUMENTS 3,183,302 A * 5/1965 Wochner ..... H02G 15/113 174/138 F
4,143,934 A 3/1979 Siebert
4,504,106 A * 3/1985 Fechter ..... H01R 13/6392 439/297
5,299,951 A 4/1994 Blaetz
5,306,176 A 4/1994 Coffey
5,755,588 A 5/1998 Sweatman et al.
5,772,462 A 9/1998 Osten
6,036,526 A * 3/2000 Alfis, III ..... H01R 4/70 439/369

(Continued)

FOREIGN PATENT DOCUMENTS

WO WO 2003001631 1/2003

OTHER PUBLICATIONS

Notice of Allowance for U.S. Appl. No. 16/306,564 dated Jan. 13, 2020.

(Continued)

*Primary Examiner* — Oscar C Jimenez
(74) *Attorney, Agent, or Firm* — Vista IP Law Group, LLP

(57) ABSTRACT

A casing for connecting first and second power cords, the casing having a set of grip mechanisms with facing grip members that have serrated surfaces arranged to grip the first power cord and provide increased grip pressure in response to tension applied to the first power cord in order to resist the first power cord being pulled through the grip members and out of the casing.

8 Claims, 9 Drawing Sheets

(56) References Cited

U.S. PATENT DOCUMENTS

| | | | | |
|---|---|---|---|---|
| 6,080,004 | A * | 6/2000 | Kovacik | H01R 13/6392 439/352 |
| 6,099,340 | A * | 8/2000 | Florentine | H01R 13/6392 439/367 |
| 6,878,007 | B1 | 4/2005 | Decker | |
| 7,189,100 | B1 | 3/2007 | Colbourne | |
| 7,442,067 | B1 | 10/2008 | Amaral | |
| 9,197,005 | B2 | 11/2015 | Zaurrini | |
| 10,923,851 | B2 * | 2/2021 | Betterridge | H01R 13/501 |
| 2004/0097120 | A1 * | 5/2004 | Limber | H01R 13/6392 439/369 |
| 2010/0317222 | A1 | 12/2010 | Tom et al. | |
| 2013/0165002 | A1 | 6/2013 | Nooner | |
| 2014/0235119 | A1 * | 8/2014 | Zaurrini | H01R 13/6392 439/892 |
| 2016/0268723 | A1 * | 9/2016 | Berengut | H01R 13/6392 |

OTHER PUBLICATIONS

Non-Final Office Action for U.S. Appl. No. 16/306,564 dated Jul. 23, 2019.

Amendment Response to NFOA for U.S. Appl. No. 16/306,564 dated Dec. 17, 2019.

International Search Report dated Jul. 28, 2017 for PCT Appln. No. PCT/AU2017/050538.

International Written Opinion dated Jul. 28, 2017 for PCT Appln. No. PCT/AU2017/050538.

International Preliminary Report on Patentability dated Sep. 24, 2018 for PCT Appln. No. PCT/AU2017/050538.

* cited by examiner 12
30
44
31
DETAIL Y
SCALE 2 : 1

37
12
14
56
37
31
26
30
51
15
50
37
30
Y
Z
30
37
2
52
54
55
43
56
52
55

26
43
41
30
44
37
31
DETAIL Z
SCALE 2 : 1

CASING FOR CONNECTING POWER CORDS

RELATED APPLICATION DATA

This application is a continuation of U.S. patent application Ser. No. 16/306,564 filed on Dec. 1, 2018, now U.S. Pat. No. 10,658,786, which is the national phase of International Patent Application No. PCT/AU2017/050538 filed on Jun. 2, 2017, which claims priority from and the benefit of Australian Patent Application No. 2016203688 filed on Jun. 2, 2016. The entire disclosures of all of the above applications are expressly incorporated by reference herein.

FIELD

The present invention relates to a casing for connecting power cords.

BACKGROUND

A number of connection devices have been used to connect a plug and socket of two power cords.

The cords may be held by internal grips that are passively biased against the cords. However, the cords generally pull through the grips under tension which causes power between the cords to be disconnected. The plug and socket remain inside the device and the device needs to be opened to confirm the disconnected state of the cords and to then reconnect the plug with the socket.

If a power tool is in use and suddenly stops working the tool may be left on while the device is opened and the cords are reconnected, which is particularly hazardous as the tool may suddenly become active again without warning when the cords are reconnected.

Such connection devices generally provide a weather proof connection around the leads but are not water proof as there is no complete seal around the device.

The devices all have a main clasp that simply clips opposite sides of the device together. If the clasp is knocked or kicked, the device can open and allow the plug and socket to be accidentally released and/or allow water inside the device.

Due to the risk of water incursion, the connection devices are not suitable for use on work sites especially those subject to pools of water or rain.

SUMMARY

In one aspect, the invention provides a casing for clamping onto a power cord including first and second shells with a hinge to connect respective first sides of the shells and a latch to mechanically connect the second side of the shells, the casing including a port to receive the cord and a grip mechanism to resist the cord being pulled out of the casing, wherein: a grip mechanism is provided in each shell, in opposing relation, to grip opposite sides of the cord and each grip mechanism includes: a grip member and a biasing element that exerts a bias force to urge the grip member away from the base and toward the cord; wherein the grip member is able to deflect toward the base of the shell, against the bias force, when subject to a lateral closing force as the shells are closed together in order to accommodate the cord; and wherein the grip members rotate toward the cord in response to axially applied pull-out tension on the cord so as to clamp the cord and thereby resist the cord being pulled through the grip members.

In one embodiment, the casing further includes an opening for receiving an other cord and a second set of grip mechanisms, arranged in opposed relation in the first and second shells to grip the other cord and resist pull-out after the cords are electrically connected inside the casing.

In one embodiment, the casing further includes seals between the first and second shells and a locking lever to pull the shells together and energize the seals, wherein the lever is mounted to the first shell and has an associated pivotal latch intermediate ends of the locking lever to hook onto a catch on the second shell, and an over-center pivot connection connects the locking lever to the first shell so that inadvertent release of the lever is resisted when the lever is moved into an engaged condition to close the casing.

In one embodiment, the locking lever is hinged to the shell between external side ribs.

In one embodiment, a free end of the lever is tucked against a side of the casing when in the locked position to protect the lever from accidental release.

In another aspect, the invention provides a casing for connecting first and second power cords, the casing having a set of grip mechanisms with facing grip members that have serrated surfaces arranged to dynamically grip one of the cords and provide increased grip pressure in response to tension applied to the cord in order to resist the cord being pulled through the grip members and out of the casing.

In one embodiment, the grip members are biased toward the cord.

In one embodiment, the casing further includes a second set of grip mechanisms to engage the other cord such that neither cord is able to be pulled out of the casing while the casing remains in a closed and locked condition.

In another aspect there is provided a power cord with a casing fixed on an end of the cord, the casing including: two shells hinged together on one side, to move between an open and closed condition; a lock to hold the shells together in the closed condition; an opening in one end of the casing in which a cable of the power cord is received; a port formed in an opposite end of the casing for a cable of a second power cord; and an internal bay in which a socket connector of the power cord is mounted, the bay also accommodating a plug connector of the second power cord when connected to the socket connector; wherein the casing further includes a grip mechanism mounted in each shell, each grip mechanism including a spring biased grip member, the grip members being biased against the second power cord as the casing is closed and locked, the grip members further being pivotally mounted to rotate toward each other in response to axially applied pull-out tension on the second power so as to apply increased grip pressure to clamp the second power cord and thereby resist the second power cord being pulled through the grip members.

In one embodiment, a seal is provided in the port formed of a half-cylindrical seal in each shell, the half-cylindrical seals having internal annular sealing fins to seal against the second power cord.

In one embodiment, each half-cylindrical seal in the port includes a plug which pulls through an aperture in the respective shell to locate and secure the seal in the port.

In one embodiment, another seal is provided in the opening, fitted around the first power cord, and a gasket is fitted into a groove in one of the shells, the gasket extending around the bay and under the respective seals, the gasket being formed of a continuous loop of expanded foam-molded material.

In one embodiment, the seals have lateral wings that taper to allow the gasket to transition laterally out from under the seals such that an upper surface of the wings is substantially in line and flush with the gasket.

In one embodiment, a blade that matches the shape and profile of the gasket projects from the other shell to energise the gasket and engage the seal around the first power cord when the shells are closed together.

In one embodiment, the socket connector of the first power cord has integrally moulded ears with holes for receipt of fasteners to secure the plug connector into the casing.

In one embodiment, the lock has a latch coupled to one of the shells for engaging a catch on the other one of the shells, the latch being hinged to a pivoting locking lever for additional leverage and enhanced compression.

In one embodiment, the locking lever is hinged to the casing between external side ribs.

In one embodiment, a free end of the lever is tucked against a side of the casing when in the locked position to protect the lever from accidental release.

In one embodiment, the socket connector of the first power cord has a light to indicate the first power cord is live.

In one embodiment, the shells are formed of transparent material to allow a visual inspection of the connection between the first and second power cords.

Further advantages and features of embodiments will become apparent when reading the following detailed description in conjunction with the drawings.

BRIEF DESCRIPTION OF THE DRAWINGS

The embodiments are described, by way of non-limiting example only, with reference to the drawings, in which.

DETAILED DESCRIPTION

Figure 1:
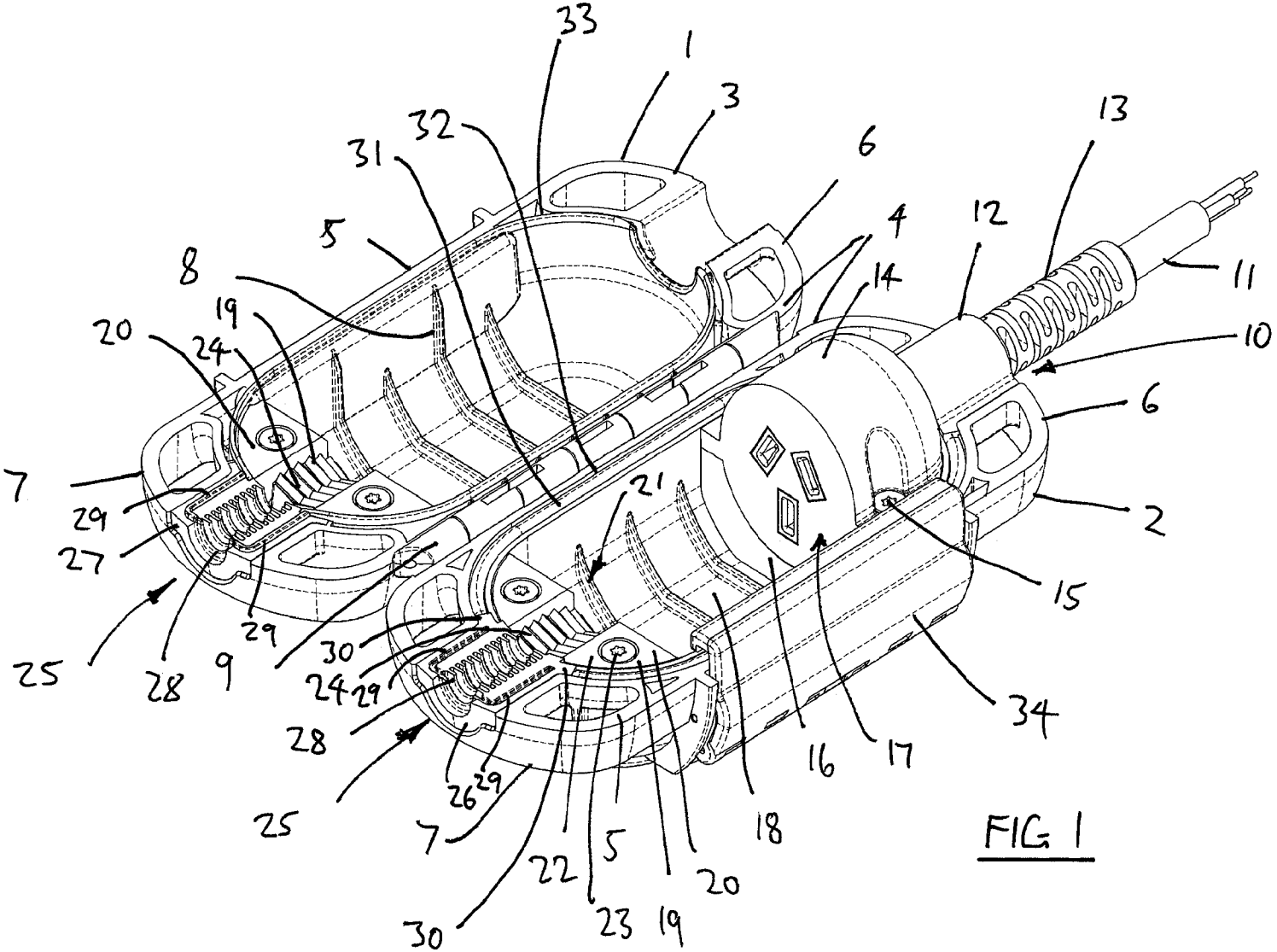
FIG. 1 is a perspective view of a casing with a first power cord.

Various embodiments are described hereinafter with reference to the figures. It should be noted that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Figure 2:
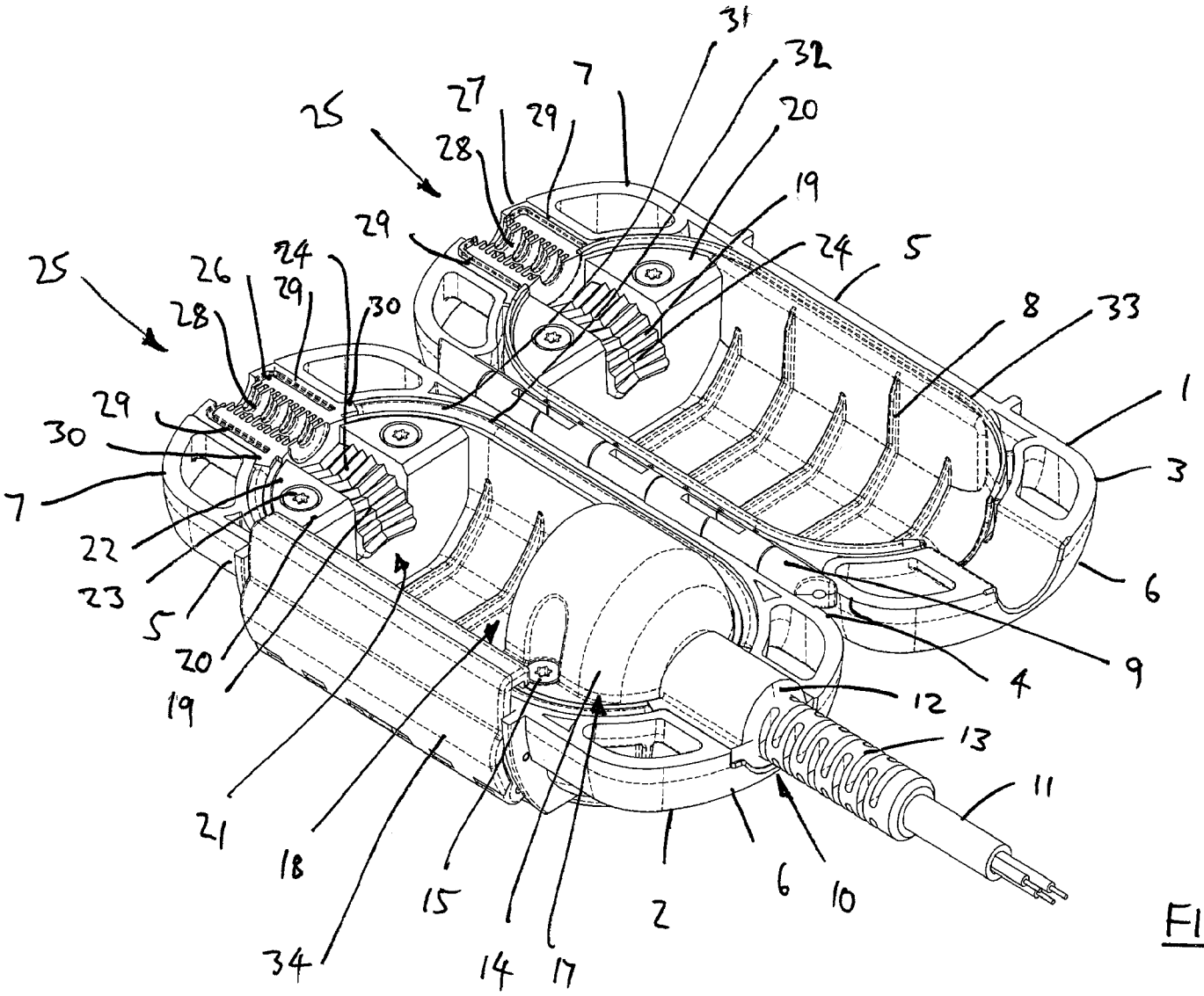
FIG. 2 is another perspective view of the casing.

FIGS. 1 and 2 show a casing 1 as including two shells 2, 3 in an open configuration. The shells 2, 3 have generally straight sides 4, 5, curved ends 6, 7 and internal reinforcing ribs 8. A hinge 9 connects the shells 2, 3 along a substantial length of one side 4 of each shell 2, 3.

The first end 6 has an opening 10 that receives a cable 11 and seal 12 of a first power cord 13. The cord 13 terminates in a socket connector 14 which is fixed to the shell 2 by fasteners 15.

The socket connector 14 is nested on an internal wall 16 toward one end 17 of a bay 18. A grip mechanism 19 is housed in a compartment 20 at an opposite end 21 of the bay 18. The compartment 20 has a cover 22 that is fixed in place with fasteners 23. The grip mechanism 19 includes a central grip member 24 aligned with a port 25 in the end 7 of the shell 2.

A corresponding compartment 20 and grip mechanism 19 is mounted in the second shell 3, with an associated grip member 24 aligned with a port 25 formed in the end 7 of the second shell 3.

A half-cylindrical seal 26 is fitted into the port 25 between the end 7 of the shell 2 and the grip mechanism 19. A corresponding seal 27 is provided in the second shell 3. The seals 26, 27 internal annular sealing fins 28 and elongate lips 29 which engage when the seals 26, 27 are pressed together.

The seal 26 also has lateral wings 30 that fit over a gasket 31 seated in a groove 32 which extends around an inside perimeter of the shell 2 and under both seals 12 and 26.

The second shell 3 has a blade 33 that matches the position and profile of the gasket 31 and seals 12, 26 in order to press against and energize the gasket 31 and seals 12, 26 when the shells 2, 3 are moved to a closed condition. The shells 2, 3 can subsequently be secured together by lock 34.

Figure 3:
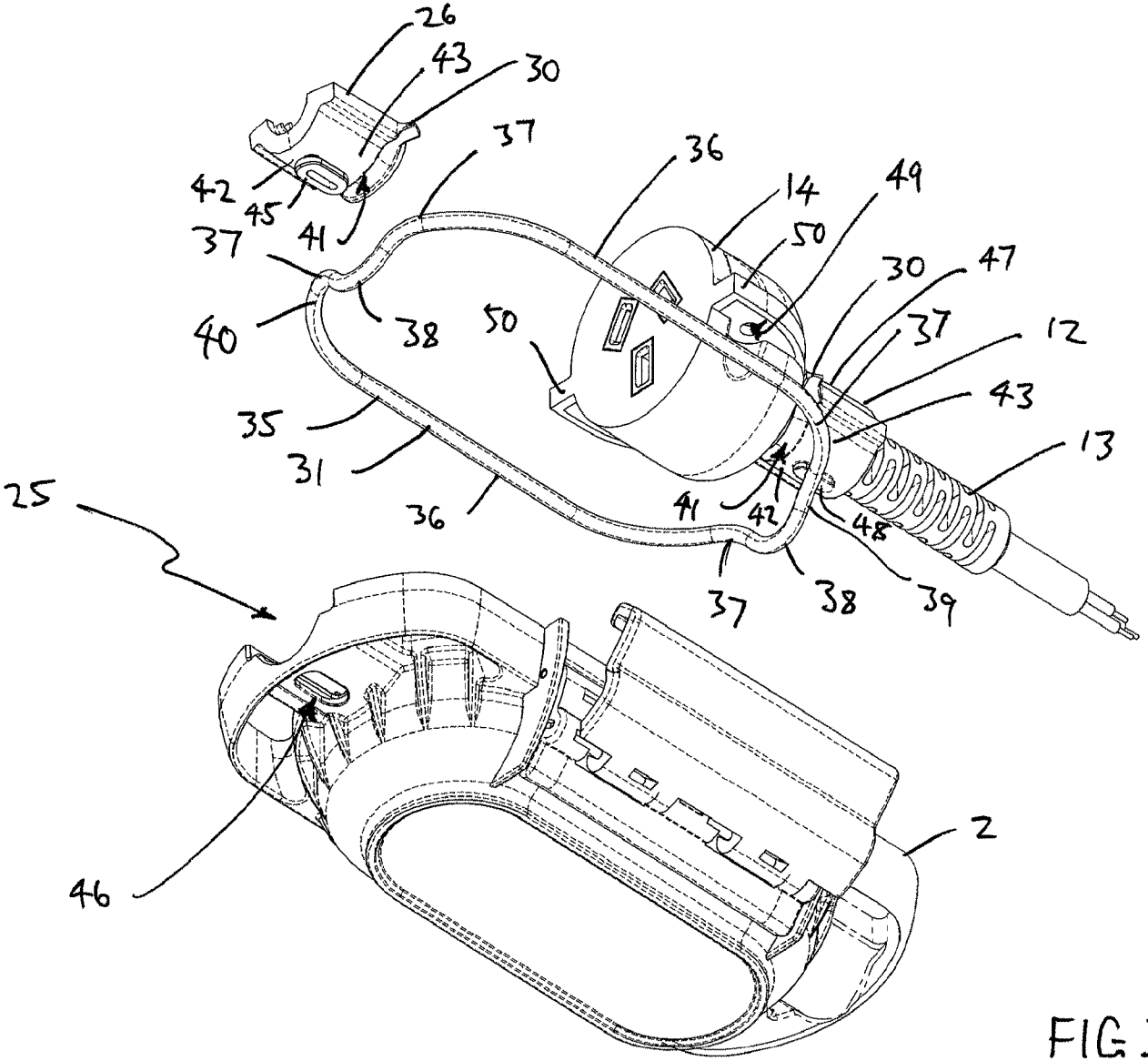
FIG. 3 is an underside perspective view illustrating a shell of the casing, the power cord, gasket and seals.

FIG. 3 shows the gasket 31 is formed as a continuous strip 35. The gasket 31 is preferably formed by of a polymeric material and is made by a process of expanded foam moulding so as to have favorable compression and sealing characteristics. Since the gasket 31 is formed as a single strip 35, there are no joins that might otherwise cause problems with sealing.

The gasket 31 has two sides sections 36 with shoulder sections 37 that loop down into cradle sections 38 at either end 39, 40. The cradle sections 38 fit into associated channels 41 at an underside 42 of a neck 43 of each seal 12, 26. The channels 41 track around the neck 43 of the seals 12, 26 and then laterally under the wings 30 which taper so that the upper surface 44 of each wing 30 is substantially in line and flush with the gasket 31 either side of the seal 26.

The seal 26 may be integrally moulded with the gasket 31, however, it is preferred the seal 26 is formed of slightly harder although still compressible elastomeric material able to be moulded into the more complex shape shown.

The seal 26 includes a plug 45 that is able to be pushed through a corresponding aperture 46 in the shell, in order to secure the seal 26 in relation to the port 25. This represents a particularly simple mechanism for locking the seal 26 in place.

The other seal 12 is secured in place as a result of being formed as a collar 47 that is fitted over the cord 13. A lug 48 assists in properly locating the seal 12 in the shell 2 while the socket connector 14 is fixed in place with the aid of through-holes 49 which are integrally moulded into ears 50 of the connector 14.

Figures 4A, 4B, 4C:
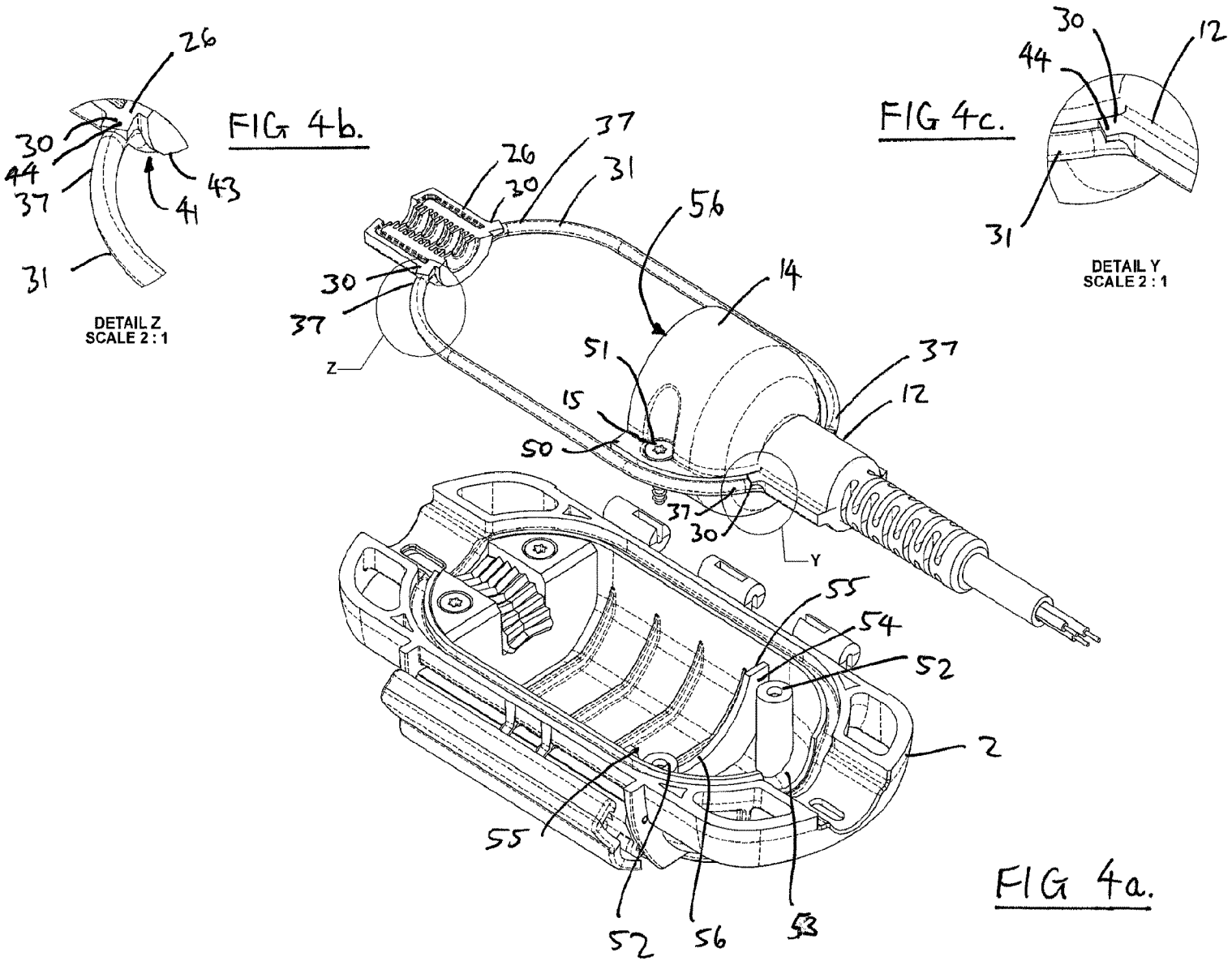
FIG. 4*a* is a topside perspective view of the shell, power cord, gasket and seals.
FIG. 4*b* is a partial perspective view of detail 'Z' shown in FIG. 4*a;*
FIG. 4*c* is a partial perspective view of detail 'Y' shown in FIG. 4*a;*

FIG. 4*a* shows the fasteners 15 in the form of screws 51 which locate in posts 52 moulded into a base 53 of the shell 2. The posts 52 are positioned behind a wall 54 which has raised side ledges 55 to support the ears 50 and a curved seat 56 to support the socket connector 14 and provide a flush finish with the face 56 of the socket connector 14.

FIG. 4*a* also shows the seal 12, 26 positioned on the gasket 31, with the wings 30 substantially flush and in line with the shoulder sections 37 of the gasket 31.

FIG. 4*b* is an enlarged view showing the seal 26 fitted to the gasket 31, where the shoulder section 37 can be seen transitioning from the channel 41 around the neck 43 of the seal 26 and out from under the wing 30 such that the upper surface 44 of the wing 30 is substantially in line and flush with the gasket 31.

FIG. 4*c* shows a similar view of the seal 12 where the gasket 31 is again illustrated as exiting from under the wing 30 in line and substantially flush in relation to an upper surface 44 of the wing 30.

Figure 5:
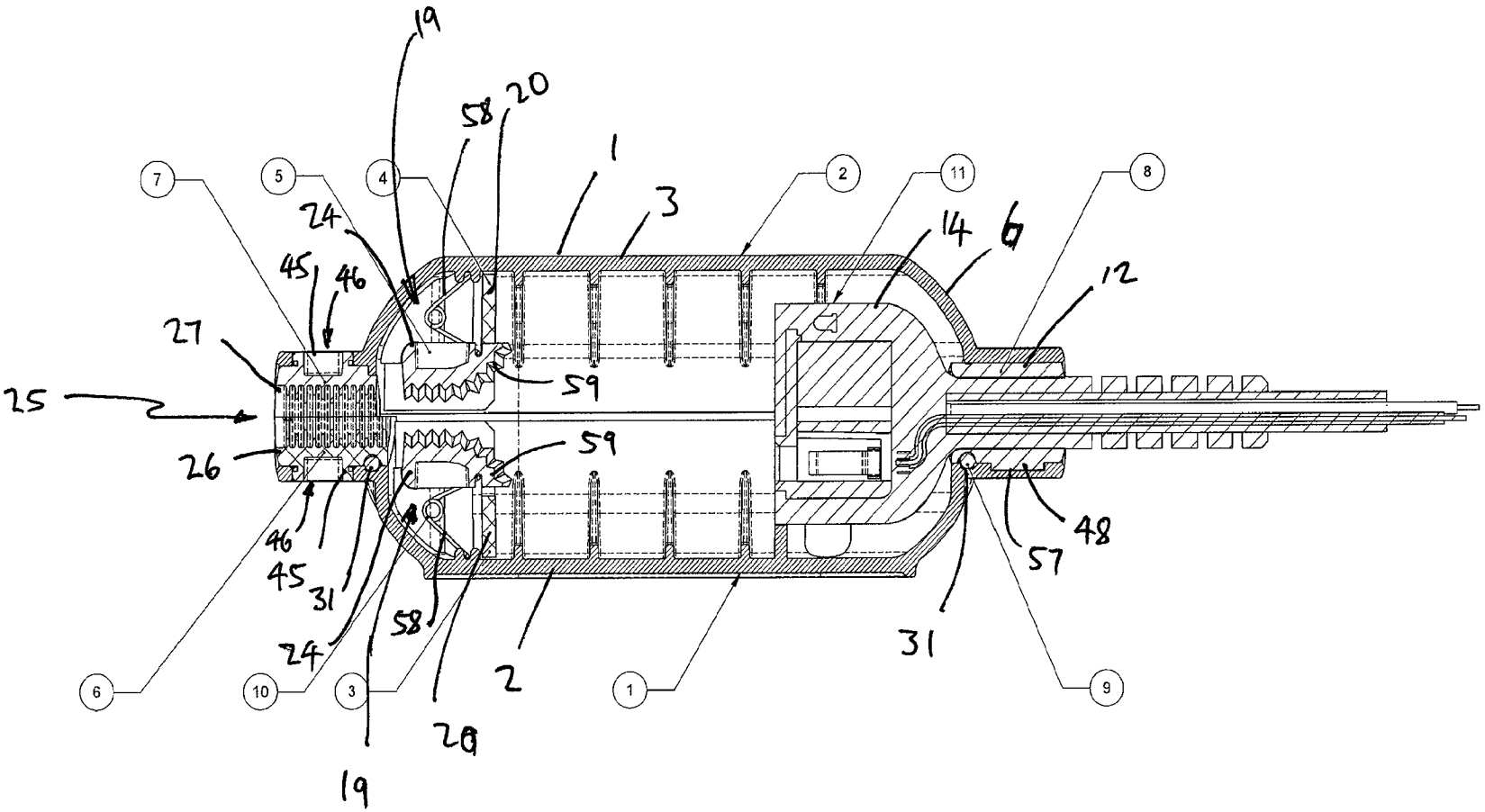
FIG. 5 is a cross-sectional view of the casing with the first power cord secured in the casing.

FIG. 5 shows a cross-sectional view of the casing 1 in a closed condition. In that condition, the plug 45 is located in the aperture 46 formed in shell 2 to secure the seal 26 in the port 25. The other seal 27 likewise has a plug 45 positioned in an associated aperture 46 in the other shell 3. The seals 26, 27 are compressed together while a waterproof seal is formed between the seal 26 and the gasket 31.

At the other end 6 of the casing 1, the seal 12 is positioned such that the lug 48 is located in a recess 57 and the socket connector 14 is fixed in place in order for the seal 12 to form a second water proof seal with the gasket 31.

The grip mechanisms 19 are mounted in the respective compartment 20 in opposing relation and include a biasing element 58 that works between the shell 2, 3 and the grip members 24 to exert a bias force which urges the grip members away from a base of the respective shell. This results in the free ends 59 of the grip members 24 being urged toward each other. The specific form of biasing element is shown as a spring which urges the respective free end 59 of each grip member 24 to pivot out of the compartment 20 however other forms of biasing may be employed as required.

Figure 6:
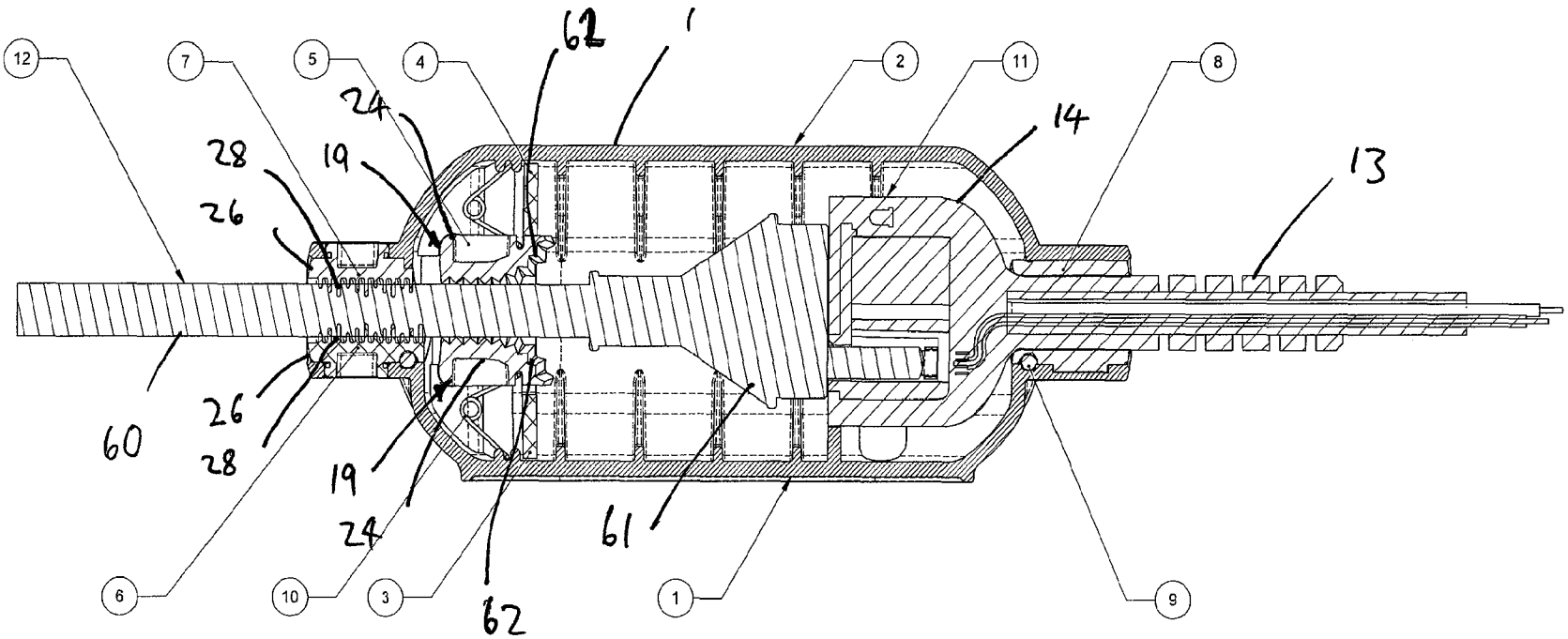
FIG. 6 is a cross-sectional view showing a second power cord secured in the casing and connected to the first power cord.

FIG. 6 shows the casing 1 with a second power cord 60 and an electrical plug connector 61 engaged with the socket connector 14 of the first power cord 13. The cord 60 passes though the seals 26, 27 where a waterproof seal is provided by the fins 28 engaging the cord 60.

The cord 60 also passes between the grip mechanisms 19. When the shells are closed together, the grip members initially yield or deflect toward the base of the associated shell, against the bias force of the biasing elements as a lateral closing force is applied, in opposition to the biasing force, to accommodate the cord. This allows for a soft close of the casing. However, the grip members remain biased away from the base and still grip opposite sides of the cord. If any axial pull-out tension is applied to the cord the grip members will rotate inwardly to lock onto the cord. For that purpose, the grip members pivot about axes positioned toward the port that extend laterally of the shells, between first and second sides of the respective shell. A greater pull-out tension will generate on increased gripping force.

The grip members 24 can have serrated surfaces 62 to further assist in dynamically gripping the cord 60 if any tension is applied to the cord 60, as a result of the grip members 24 rotating in toward the cord 60 for a tighter grip. The grip mechanisms thereby act as a one-way stop to prevent the plug connector 61 being inadvertently pulled free of the socket connector 14.

As a result, when the cord 60 is connected to the first cord 13, and the casing 1 is closed, the cords 13, 60 will not only be waterproof sealed in the casing 1 but will also be prevented from separating.

Figure 7B:
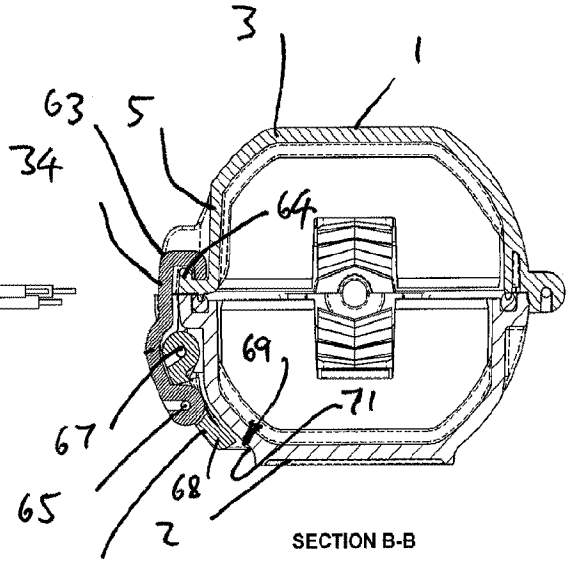
FIG. 7*b* is a cross-sectional view of the casing, along the line B-B show in FIG. 7*a;*
Figure 7A:
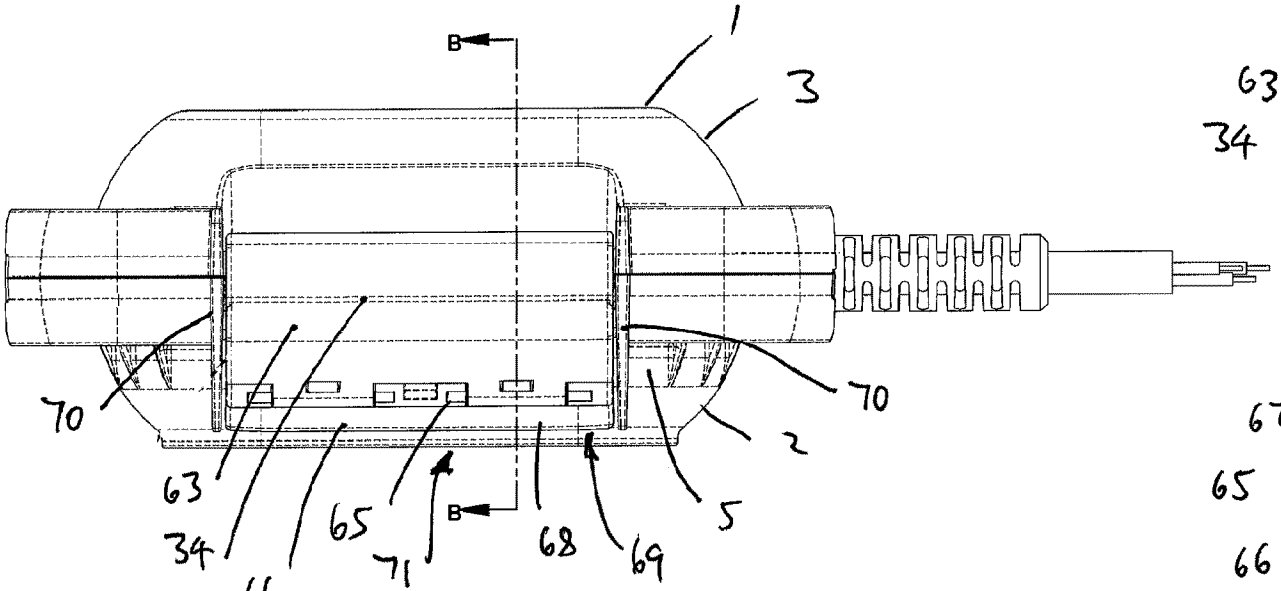
FIG. 7*a* is a side view of the casing in a closed condition.

With reference to FIGS. 7*a* and 7*b* the lock 34 is described in more detail as a double-acting lock to provide security against the casing 1 being inadvertently opened.

The lock 1 has a lock body that extends a substantial distance along the side 5 of the shells and includes a latch 63 that hooks onto a catch 64 on the shell 3.

The latch 63 is pivotally coupled via a hinge 65 to a locking lever 66 that nests between the latch 63 and the shell 2. The locking lever 66 is pivoted from a second hinge 67 that provides an over-center mounting that requires a bias force to be overcome to lock and unlock the lever 66. The lever has a free end 68 that tucks into a space 69 between external ribs 70, at an underside 71 of the shell when in the locked condition.

The lever 66 provides additional leverage to pull the latch 63 closed and energize the waterproof seals inside the casing 1. By having the lock body hinged along a substantial length of the casing 1, together with a hinge 9 of corresponding length along the opposite sides 4 of the shells 2, 3, a uniform and reliable seal can be achieved.

The lever 66 is also protected from inadvertent release as it is tucked up against the casing 1, between the ribs 70 and is held in place in the fully engaged condition by the over-center mounting. A release force is needed to overcome the over-center bias in order to release the lock. The release force is preferably designed to be higher than a child is able to apply, for safety reasons. Even if the lever 66 was accidentally released, the latch would still serve to secure the shells 2, 3 together and provide a secondary locking function until the lock lever is re-engaged.

Figure 8:
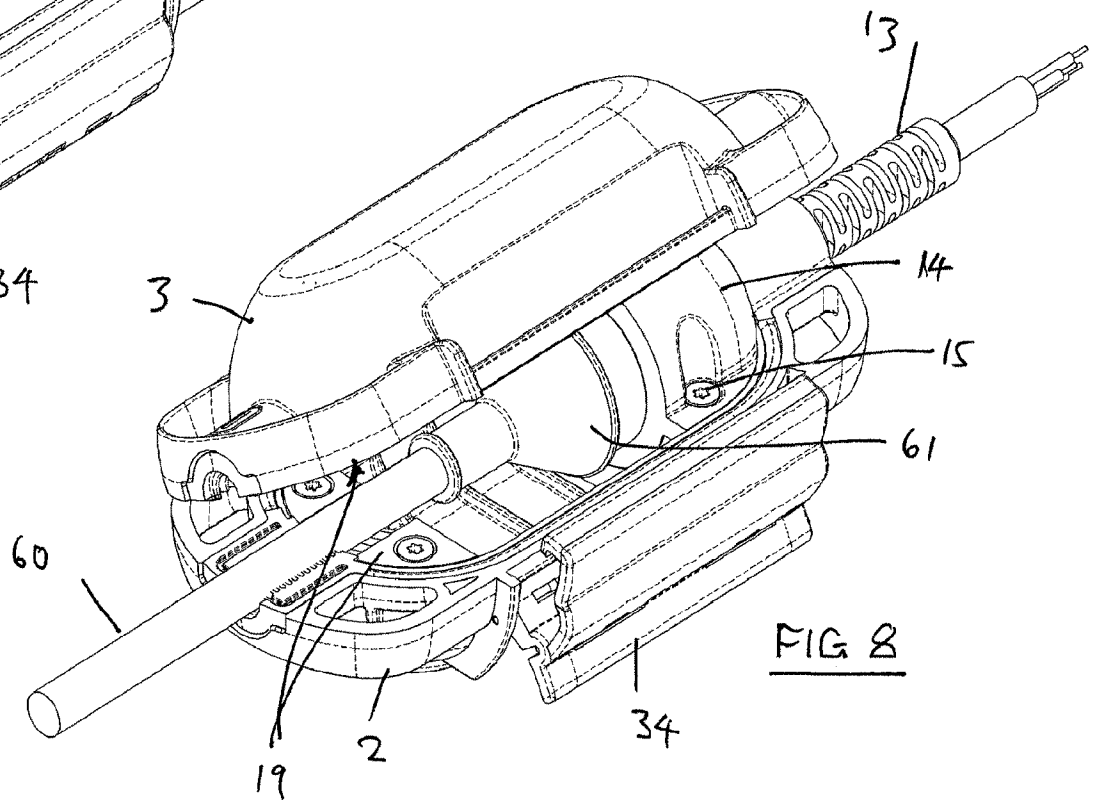
FIG. 8 is a perspective view of the casing in an open condition, with the first and second power cords connected.

FIG. 8 shows the lock 34 in a released condition, prior to being engaged, with the plug connector 61 inserted in the socket connector 14. The socket connector 14 is fixed in place by the fasteners 15 and the plug connector 61 is fixed in the casing 1 by the set of grip mechanism 19, when the shells 2, 3 are closed together.

Figure 10:
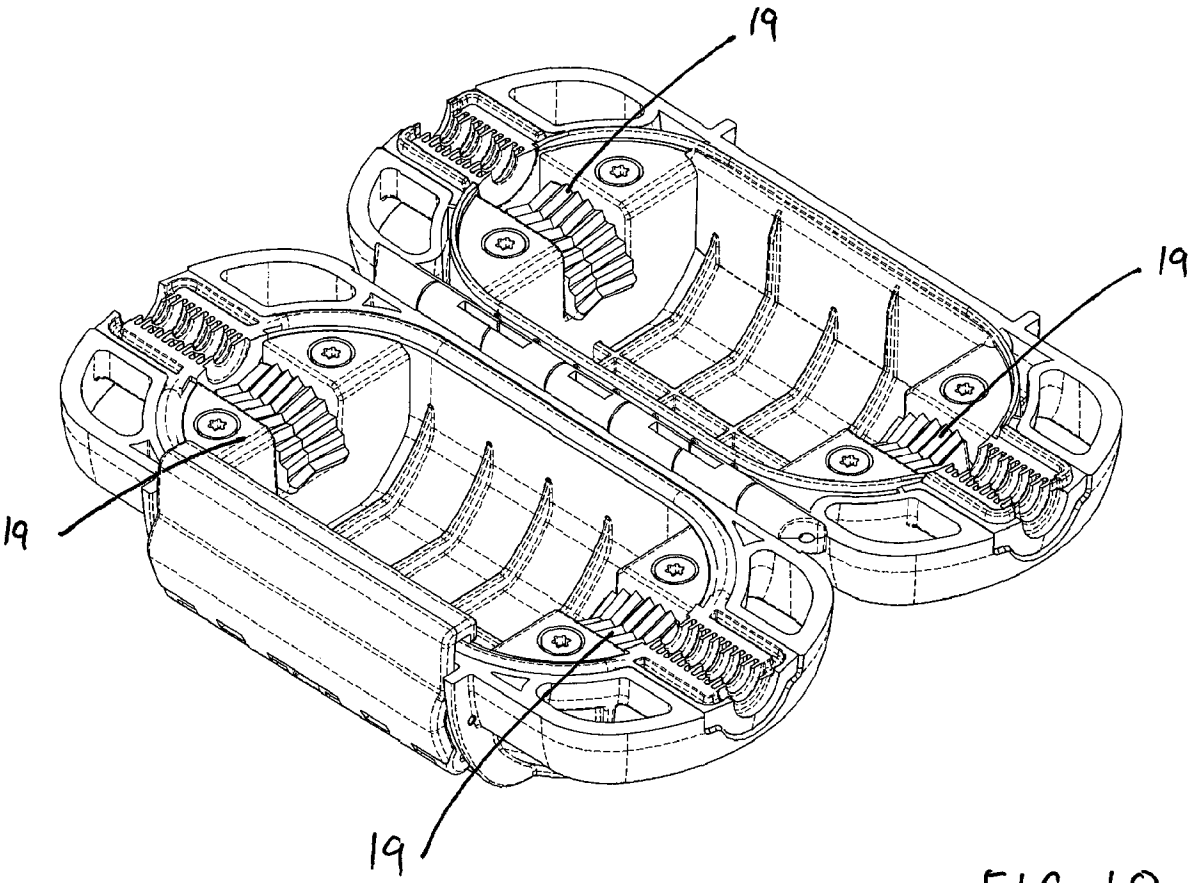
FIG. 10 is a perspective view of a casing with two sets of grip mechanisms.

In an alternative embodiment, the casing 1 could be modified to accept a power cord with a simple socket head (not shown), in which case instead of the fasteners 15, a second set of grip mechanisms could be installed to hold each power cord in place as illustrated in FIG. 10.

Figure 9:
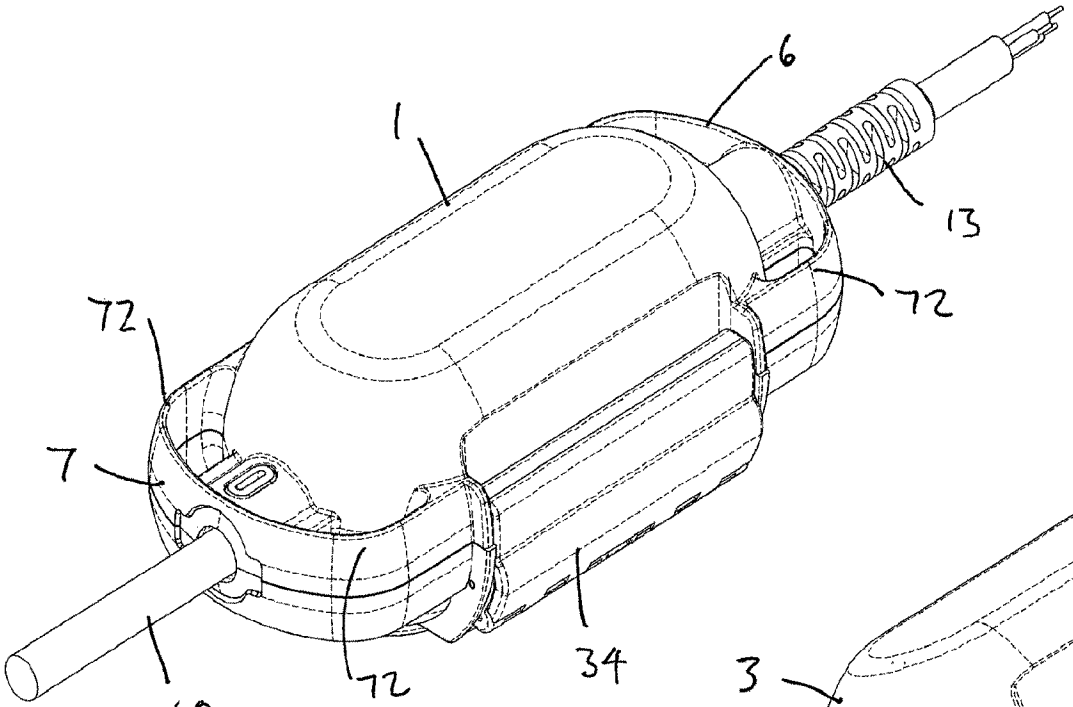
FIG. 9 illustrates the casing of FIG. 8 in a closed condition.

In any event, the power cords 13, 60 will be reliably gripped and held in a waterproof environment inside the casing 1 when the lock 34 is engaged as shown in FIG. 9.

With regard to FIG. 9, although not specifically illustrated, it should be appreciated the shells can be formed of clear plastics in order to provide for easy visual confirmation of the connection state of the cords 13, 60 and an LED light or similar can be moulded into the socket connector 14 to show when the first cord 13 is live.

As also shown in FIG. 9, the casing 1 includes loops 72 at each end 6, 7 to receive a hanging hook or the like, if the casing 1 needs to be suspended from a ceiling or rack, to reduce potential hazard.

Additional beneficial features may include further external ribbing for additional strength and/or a weather-proofing secondary seal (not shown) which follows the same path as the gasket 31 around a perimeter of the shell 2. The secondary seal may comprises a simple groove in one of the shells and a matching blade on the other shell that fits inside the groove when the shells are in a closed configuration.

The above features all render the casing particularly suitable for connecting power cords in wet environments and can assist in avoiding accidents associated with the prior art devices.

In some environments, however, the casing may be provided without the seals that render the casing waterproof and instead have only a weather-proof seal. The casing may even be manufactured without waterproof or weatherproof seals depending on the environment in which the casing is intended to be used, provided the casing includes at least a suitable lock and one or more sets of grip mechanisms in order to resist the power cords being pulled out of connection when the casing is closed.

It should be appreciated the grip mechanisms of the invention have grip members that yield or deflect to receive a power cord, in order to enable a soft close of the casing, while providing a dynamic grip by rotating toward the cord to increase grip pressure in response to axial pull-out tension in order to resist electrically connected cords separating inside the casing. The lever action lock then provides mechanical advantage to energize the seals of the casing and an over-center mounting provides protection from inadvertent release of the lock.

The soft close feature offered by the lock mechanisms means the cords can be connected and the casing closed without any additional manipulations of the cords, after which the lever action lock can be engaged with only one hand in order to provide a secure and reliable water proof seal around the cords.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A casing for clamping onto a power cord, the casing comprising:

first and second shells with a hinge to connect respective first sides of the shells and a latch to mechanically connect a second side of one of the shells, the casing including a port to receive the power cord;

wherein each of the first and second shells has a grip mechanism, in opposing relation, to grip opposite sides of the power cord, and each of the grip mechanisms includes a grip member and a biasing element that exerts a bias force to urge the grip member away from a base of the corresponding shell and toward the power cord;

wherein each of the grip members is able to deflect toward the base of the corresponding shell, against the bias force, when subject to a lateral closing force as the shells are closed together in order to accommodate the power cord; and wherein the grip members are configured to rotate toward the power cord in response to axially applied pull-out tension on the power cord so as to clamp the power cord to resist the cord being pulled through the grip members.

2. The casing of claim 1, wherein the grip mechanisms form a first set of grip mechanisms, and wherein the casing further comprises an opening for receiving an other power cord and a second set of grip mechanisms, arranged in opposed relation in the first and second shells to grip the other power cord to resist pull-out after the power cords are electrically connected inside the casing.

3. The casing of claim 1, further including seals between the first and second shells and a locking lever to pull the shells together and energize the seals, wherein the locking lever is mounted to the first shell and has an associated pivotal latch to hook onto a catch on the second shell, and an over-centre pivot connection connecting the locking lever to the first shell so that inadvertent release of the locking lever is resisted when the locking lever is moved into an engaged condition to close the casing.

4. The casing of claim 3, wherein the locking lever is hinged to the casing between external side ribs.

5. The casing of claim 4, wherein a free end of the locking lever is tucked against a side of the casing when in a locked position to protect the locking lever from accidental release.

6. The casing of claim 1, wherein the grip members have serrated surfaces arranged to grip the power cord and provide increased grip pressure in response to tension applied to the power cord in order to resist the power cord being pulled through the grip members and out of the casing.

7. The casing of claim 6, wherein the grip members are biased toward the power cord.

8. The casing of claim 6, further including additional grip mechanisms to engage an additional power cord such that both the power cord and the additional power cord cannot be pulled out of the casing while the casing remains in a closed and locked condition.

* * * * *